US011371167B2

(12) United States Patent
Pokorny et al.

(10) Patent No.: US 11,371,167 B2
(45) Date of Patent: Jun. 28, 2022

(54) DEVICE AND METHOD FOR PRODUCTION OF NANOFIBROUS AND/OR MICROFIBROUS LAYERS HAVING AN INCREASED THICKNESS UNIFORMITY

(71) Applicant: Contipro a.s., Dolni Dobrouc (CZ)

(72) Inventors: Marek Pokorny, Cenkovice (CZ); Adela Kotzianova, Opava (CZ); Jan Klemes, Moravska Trebova (CZ); Katerina Knotkova, Chocen (CZ); Martin Fogl, Letohrad (CZ); Vladimir Velebny, Zamberk (CZ)

(73) Assignee: Contipro a.s., Dolni Dobrouc (CZ)

( * ) Notice: Subject to any disclaimer, the term of this patent is extended or adjusted under 35 U.S.C. 154(b) by 0 days.

(21) Appl. No.: 17/054,610

(22) PCT Filed: May 27, 2019

(86) PCT No.: PCT/CZ2019/050026
§ 371 (c)(1),
(2) Date: Nov. 11, 2020

(87) PCT Pub. No.: WO2019/228578
PCT Pub. Date: Dec. 5, 2019

(65) Prior Publication Data

US 2021/0324541 A1 Oct. 21, 2021

(51) Int. Cl.
*D01D 5/00* (2006.01)

(52) U.S. Cl.
CPC ..... *D01D 5/0092* (2013.01); *D01D 5/0069* (2013.01); *D10B 2321/06* (2013.01)

(58) Field of Classification Search
None
See application file for complete search history.

(56) References Cited

U.S. PATENT DOCUMENTS 4,587,192 A * 5/1986 Lind ..... G03G 15/101 118/638
5,041,183 A * 8/1991 Nakamura ..... H05K 3/323 156/264

(Continued)

OTHER PUBLICATIONS

Fowler, Steve, Ohms per Square What?, 2011, EDS Journal, 3 pages, www.edsjournal.com/techpapr/ohmtr/ohm.htm (Year: 2011).*

(Continued)

*Primary Examiner* — Niki Bakhtiari
*Assistant Examiner* — Emmanuel S Luk
(74) *Attorney, Agent, or Firm* — Wood Herron & Evans LLP

(57) ABSTRACT

Device for the production of nanofibrous and/or microfibrous layers having an increased thickness uniformity by spinning a liquid material (3), said device comprising: a collecting electrode (6), a spinning nozzle (1) for dispensing the liquid material (3) to be spun, an assembly for guiding the collecting electrode (6) and/or for guiding a base strip (5) along the collecting electrode (6) or adjacent to it, such that—in the area faced by the outlet orifice (10) of the spinning nozzle (1)—the collecting electrode (6) and/or the base strip (5) move(s) in the direction (MD) spaced from the outlet orifice (10) of the spinning nozzle (1), a power supply for generating a voltage of 10 to 150 kV between the collecting electrode (6) and the spinning nozzle (1), at least one body (2), which moves along the liquid surface to destabilize the locations of the points where fibres (4) are formed on the surface of the liquid material (3) at the outlet orifice (10) of the spinning nozzle (1). The nanofibrous and/or microfibrous layers having an increased thickness uniformity are produced by spinning a liquid material (3) in an electrostatic field, wherein a body (2) is moved along the surface of the spun liquid in order to destabilize positions of locations, where the fibers originate.

14 Claims, 3 Drawing Sheets

(56) References Cited

U.S. PATENT DOCUMENTS

| | | | | |
|---|---|---|---|---|
| 8,727,756 | B2 | 5/2014 | Pokorny et al. | |
| 9,890,475 | B2 | 2/2018 | Maly et al. | |
| 2002/0084178 | A1 | 7/2002 | Dubson et al. | |
| 2008/0284050 | A1* | 11/2008 | Mares | D01D 5/0069 264/10 |
| 2009/0209840 | A1* | 8/2009 | Axelgaard | A61N 1/0496 600/391 |
| 2010/0194000 | A1 | 8/2010 | Petras et al. | |
| 2011/0223330 | A1 | 9/2011 | Green et al. | |
| 2012/0002121 | A1* | 1/2012 | Pirs | G02F 1/13471 349/14 |
| 2013/0112618 | A1* | 5/2013 | Diallo | B01D 69/087 210/641 |
| 2013/0122248 | A1* | 5/2013 | Haselby | D04H 1/728 428/131 |
| 2013/0168886 | A1* | 7/2013 | Sumida | B29D 99/0078 264/10 |
| 2014/0271795 | A1* | 9/2014 | Phaneuf | D04H 3/02 424/443 |
| 2016/0160413 | A1* | 6/2016 | Anneaux | D01F 6/12 428/36.91 |
| 2016/0325480 | A1* | 11/2016 | Soletti | A61F 2/06 |
| 2016/0361270 | A1 | 12/2016 | Stoddard et al. | |
| 2017/0130364 | A1* | 5/2017 | Ogura | D01D 5/0038 |
| 2017/0370024 | A1* | 12/2017 | Zhou | D01D 5/12 |
| 2018/0015423 | A1* | 1/2018 | Kim | B01D 69/02 |
| 2018/0291527 | A1* | 10/2018 | Beachley | D04H 1/728 |

OTHER PUBLICATIONS

Bogatin, Eric, Sheet Resistance of copper foil: Rule of Thumb #13, EDN, 2014, https://www.edn.com/sheet-resistance-of-copper-foil-rule-of-thumb-13/, 9 pages. (Year: 2014).*

Helmenstine, Anne Marie, Table of Resistivity and Conductivity, ThoughtCo., 2019, https://www.thoughtco.com/table-of-electrical-resistivity-conductivity-608499, 12 pages. (Year: 2019).*

Ossila, Sheet Resistance Equations and Theory, 2015, https://www.ossila.com/pages/sheet-resistance-theory, 11 pages. (Year: 2015).*

European Patent Office; Serach Report in related International Patent Application No. PCT/C72019/050026 dated Sep. 4, 2019; 2 pages.

* cited by examiner

DEVICE AND METHOD FOR PRODUCTION OF NANOFIBROUS AND/OR MICROFIBROUS LAYERS HAVING AN INCREASED THICKNESS UNIFORMITY

FIELD OF THE INVENTION

The present invention relates to a device and a method for the production of layers, which have nanofibrous and/or microfibrous structures, on the basis of an electrostatic spinning method, the production equipment and technology being adapted for the purpose of obtaining an increased thickness uniformity of the fibrous layers and/or an improved quality of the materials prepared using such method.

BACKGROUND ART

For several reasons, the electrostatic spinning method is a well-known, worldwide spread method for forming nanofibrous and/or microfibrous materials based on natural and synthetic polymers. The main reasons include a high level of adaptability of end devices used for manufacturing specific products, a significant level of uniqueness and irreplaceableness of the method in terms of the final structures produced as well as the fact that the present method is not limited only to a laboratory measuring scale corresponding to a small series production. This means that there is a considerable scale-up potential for such devices based on the use of the present method.

The most important qualitative characteristics of the final layers include overall dimensions of the material, base weight, diameters of the individual fibres, porosity, thickness, chemical properties of the polymers and proportions of the same, etc. In the recent years, the increasing extent of commercial use of such materials causes the demands for increased production quality. Deviations of the above values will manifest themselves by inhomogeneity of those parameters, which are desirable in connection with the given application, because differing mechanical properties, differing filtration capabilities, differing additive contents, etc., will be detected in individual points of the respective layer. In order to ensure high quality levels of the layers produced, the values if the individual quantities must remain in narrow tolerance ranges in any point of the fibrous layer or of the final product. The parameter, which influences the functional/usability features of the layer in a determinative manner, is the thickness of the same. But in fact, a uniform thickness of a layer across the entire surface of a material being produced is a critical and very difficultly attainable technological parameter. This constitutes one of the fundamental disadvantages of the electrostatic spinning method. The technical solution according to the present invention is particularly aimed at the thickness uniformity of the nanofibrous and/or microfibrous materials manufactured by means of the electrostatic spinning method.

During the production itself, a solution, typically—but without limitation—a polymeric one, is transferred by the action of electrostatic forces from one electrode to another one, while the solvent (or solvent system) contained in the transferred solution rapidly evaporates. The transfer of the solution between the two electrodes generating a strong electrostatic field occurs in a dispersed and random manner within the respective space. This leads, in particular, to an uncontrolled deposition of the individual fibres unto the collecting electrode, to a random distribution of those fibres as well as to the formation of layer having a non-uniform thickness across its surface area during the production. This also applies to layers which are formed with use of the electrospraying method wherein the microstructure of the layer consists of particles or powders rather than of fibres.

In the course of the electrostatic spinning process, during which the solvents contained in the solution rapidly evaporate, the solution undergoes, among others, the so-called chaotic phase, wherein the ray formed by the solidifying solution moves along a very complex and largely random trajectory before assuming the form of a solid fibre having from several tens of nanometres to several tens of micrometres and impinging the collecting electrode. The rate of randomness of the distribution of the fibres, which are formed from the polymeric solution and deposited on the surface of the corresponding collecting electrode or on that of the base material, is considered to be one of the qualitative features of the final layer. After having been formed on the surface of the collecting electrode or on that of the base material, the nanofibrous or microfibrous layer has different thickness in different places, the thickness varying even when repeating depositions under constant conditions.

However, there are many other factors causing inhomogeneities to occur during an electrostatic spinning process. The main influencing factors include the strength and shape of the electrostatic field along with the corresponding distribution of electrostatic lines of force, the overall geometry and arrangement of the main electrodes defining the distribution of the electrostatic field, the parameters (such as homogeneity, porosity, mechanical properties, dielectric properties, etc.) of the base material used, the evenness of the stretched base material, influence of a previously deposited layer on the distortion of the electrostatic field, etc. The formation of an inhomogeneous layer may be further caused by the parameters of the solution being processed (mainly by the conductivity and viscosity of the solution, by the solvent content in the same, etc.), by the distribution of the airflow inside the deposition chamber (wherein an additive airflow, a conditioning airflow or an electrostatic vortex may be concerned), by the temperature fluctuations of the solution or the chamber, by the continuity of the process of proportioning the polymeric solution, etc.

The final deposition enables two usable forms of fibrous layers to be obtained: a) an adequately strong, self-supporting nanofibrous or microfibrous layer is formed on a conductive collecting electrode (collector), such layer having mechanical properties allowing the same to be separated from the surface of the conductive electrode and to be subsequently transferred onto another substrate or packaging material without being damaged in the least extent; or b) a base material is interposed between the two electrodes, preferably closer to the collecting one or in contact therewith, and then a fibrous layer is deposited onto the surface of that material, the subsequent handling taking place with the use of the base material as a supporting structure, which means that the demands in terms of the mechanical properties of the final fibrous layer can be less exacting in comparison with the former case. Thereby, handling the fibrous layer can be facilitated and, in addition, a suitably selected base material can serve as an integral part of the final product incorporating a nanofibrous and/or microfibrous layer. Both the aforesaid approaches imply certain advantages and limitations. Regarding the production itself, the continuous process (referred to as b) appears to be more convenient, the procedures described with reference to the point a) being considered less suitable. A continuous production should be understood a process of depositing nanofibres onto a base material which is being unwound from one roll and simultaneously wound onto another roll (using the so-called "roll-to-roll" technique).

Each principle of spinning electrodes has certain inherent limits, the existence of the latter causing the production speed (PS, kg/h) of the particular technological plant used for producing nanofibres to be restricted. Thereby, the velocity of the movement of the base material (SS, m/s), which is necessary for obtaining a desired areal weight (AW, kg/m') corresponding to the given material width (MW, m), is also limited. The faster is the production of the fibres (up to a limit), the higher is the achievable speed of the base material being unwound. The dependence cam be expressed as follows:

$$AW = \frac{PS}{SS \cdot MW} \tag{1}$$

At the same time, the following condition must always be fulfilled:

$$PS \geq AW \cdot SS \cdot MW \tag{2}$$

On the assumption that the device used (or the spinning nozzles themselves) is (are) capable to produce nanofibrous or microfibrous layers in an amount of 100 grams per 1 hour and that it is simultaneously required to create a deposit having areal weight of 1 g/m$^2$ on a substrate having 1 metre in width, the velocity of the substrate being unwound cannot be, pursuant to the condition (2), higher than 100 m/h. As far as fibres having small diameters around 100 nm are concerned, it should be noted that the above stated estimated production is strongly overrated and that the areal weights of the layers will be very low. Nevertheless, the latter example indicates how the limits of the speed of the base material being unwound can be considered when the electrostatic spinning method is used in connection with the "roll-to-roll" technique.

Nevertheless, as stated in connection with the summary of the present invention, the velocity of unwinding the base material used poses a critical parameter in view of obtaining an increased evenness of the thickness of the layer being deposited. Therefore, attempts will be made to increase this quantity above an overcritical level. This, however, may not be possible in all of the processes concerned, which is due both to the required high value of areal weight and to the inadequate speed of the fibre production. In this view, the "roll-to-roll" technology can be disadvantageous in the end effect because it produces layers having poor quality or being non-uniform in thickness.

Another drawback of the approach described with reference to the point b) consists in that the base material must be inserted into the space between the main electrodes where the electrostatic spinning process takes place. The insertion of the base material always causes both the electrostatic field and the spinning process itself to be disturbed. Therefore, the process becomes less productive and less stable due to the attenuation of the electrostatic field. Selection of the base material to be used must be based on the fulfilment of certain criteria relating to the technological aspects of the production using the electrostatic spinning method and, simultaneously, on the fulfilment of certain criteria relating to the particular application for which the final composite material, i.e. the nanofibrous and/or microfibrous layer deposited on a base material, is intended. The effort and aim of the current development consist in obtaining a technological process that will enable the desired nanofibrous or microfibrous layers having a sufficient quality to be produced regardless of the properties of the base materials used. In other words, it is desirable to provide a production technology that will not be directly dependent on the parameters of the respective base material both in view of the quality of deposited layers and in view of the production speed.

In connection with the process parameters to be fine-tuned, the homogeneity should be considered in two different directions, namely in the cross direction (abbreviated as CD) and the machine direction (abbreviated as MD). The direction MD is defined by the principal direction of the complete production line along which the respective base material moves. According to the results of our measurements in diverse apparatuses, the final fibrous layers normally have area-wide thickness deviations ranging from 10 to 40% or even more, disregarding whether the measurements were performed in the direction CD or in the direction MD. Such values, however, are not acceptable in numerous applications. In order to make such fibrous layers industrially usable in diverse fields, such as air filtration, liquid filtration, medicine, cosmetics, etc., it is necessary to improve the technological process of depositing nanofibrous and/or microfibrous layers in a sufficient extent to achieved a distinct increase in the thickness homogeneity of the layers. An improvement of the above process is desirable not only for the aforesaid reason. An additional reason consist in that such layers should be usable as components of compound materials or active substance carriers where a uniform distribution of the active substances must be ensured by means of a validated production process.

When operating devices, which utilize the electrostatic spinning method and which are used within pilot plants or processing plants, it is always desirable to achieve the highest productivity levels possible. This is mostly realised by multiplying the numbers of the spinning electrodes used, i.e. by using electrodes comprising large numbers of nozzles in the form of capillary needles or so-called needleless/surface nozzles. However, the repulsive electrostatic forces, which are caused by the interactions between the individual flying rays, increase the rate of randomness of the layer being formed. Such forces increase proportionally to the strength of the electrostatic field (generated by applying very high voltages, such as those ranging between 30,000 and 150,000 V) that is essential for ensuring a steady production of fibres. In the end effect, the presence of those repulsive forces decreases the quality of the final layer and enlarges the deviations from the uniform planar distribution. This means that the effort for obtaining higher efficiency levels and larger volumes when producing nanofibrous and/or microfibrous materials with the use of the electrostatic spinning method often results—mostly in combination with the selection of a continuous production process according to the properties of the base material specified with regard to the requirements of a particular application—in the formation of low-quality layers having inconsistent thickness values detected in various points of their planar areas.

In this respect, it follows from the above description that the device for the production of nanofibrous layers comprises a spinning electrode and a collector (i.e. a collecting electrode). The spinning electrode is usually composed of several (tens of) thin needles or is based on a different, needleless principle that ensures an electric connection to a high-voltage or very-high-voltage power source and that enables the spinning solution to be adequately batched during the formation of the fibrous layer. The collectors are connected to the respective opposite potentials of the high-voltage power sources. In the vicinity of such electrodes, the base materials having from several tens of centimetres up to several metres in width are unwound, the unwinding process being mostly based on the "roll-to-roll" technology. In some embodiments, the spinning nozzles are moved in a manner ensuring the entire surface of the unwound base material to be covered by the deposited fibres and/or in a manner increasing the thickness uniformity of the deposited layer (which is particularly the case when needle-type spinning electrodes are employed). In general, the thickness inhomogeneities of deposited layer are reduced by means of auxiliary electrodes, moving spinning nozzles (see US20020084178A1) and/or electrically insulating materials, the function of the latter consisting in the homogenization of the electrostatic field generated between the spinning nozzle and the collecting electrode (see US20160361270A1). The main disadvantage of the technical solutions, which are based on the use of auxiliary electrodes or insulating materials, is a considerable reliance on specific process parameters, such as on those of the material to be spun including the electrical conductivity thereof. Any change to the parameters of the solution will very noticeably influence the effect of the above mentioned measures. Hence, it is often necessary to adjust such measures and to adapt it in accordance with particular conditions. Such embodiments do not provide any technical solution that would be sufficiently versatile and robust and that would not be affected by the parameters of the processed liquid polymeric substance or by the properties of the base material used.

A reduction of the thickness inhomogeneities in the fibrous layers being prepared can be achieved in that the spinning electrodes are continuously moved back and forth. The extent of the inhomogeneities can be also reduced by the action of a supplementary body moving between the spinning nozzle and the collecting electrode. This is owing to the fact that every motion of such kind causes the distribution of the electrostatic field to be destabilized, the latter becoming a time varying (dynamic) one. Then, the lines of force of such electrostatic field can contribute in making the deposited layer more uniform. When dynamically focused in the aforesaid manner, such electrostatic field can cause the thickness inhomogeneities of the layer to be reduced. For example, the technical solution described in the document US2011223330A1 relates to a vessel provided with a cover and containing the liquid material to be spun. Over the cover or between the same and a collecting electrode, an endless chain is guided in the direction CD, said chain being immersed in the spun liquid below the cover. Although the aforesaid technical solution may enable the extent of inhomogeneities to be reduced owing to the favourable influence of the destabilized electrostatic field, it still implies a lot of other disadvantages. Such disadvantages include a poor control of the amount of the spinning solution proportioned per unit of time (or of the passage of a proportioning vessel), sizes and volumes of the spinning solution being limited by the properties of the proportioning vessel used, drying of the polymeric solution on the surface of the chain before being spun, said chain acting then as an electric insulator reducing both the effectiveness of the spinning process and the amount of the newly deposited solution, requirements for a high level of accuracy of the coaxial arrangement of the wire-type electrode and the orifice of the wetting body, etc. Moreover, the speed of the production utilizing such spinning electrodes may not be sufficient for the fulfilment of the condition stated in the expression (2) when the "roll-to-roll" technique is used.

At the present time, the pilot plants or processing plants used for the production of nanofibrous or microfibrous layers are based on systems with a slowly unwound base materials used as substrates for depositing a new fibrous layer. In the overwhelming majority of applications, the base material with the nanofibrous and/or microfibrous layer freshly deposited thereon is advantageously utilized for obtaining the respective final product in a direct manner. Therefore, a suitable base material must meet both the technological requirements (i.e., it must not cause restriction of the production speed and deterioration of the quality of the deposited layers) and the application ones (i.e., it must not cause restriction of the extent of the usability of final nanofibrous or microfibrous materials). Hence, the parameters of the base materials must fulfil, among others, the following technological requirements: adequate lengthwise and widthwise dimensions of the base material (such as that in the form of a wound roll), homogeneous structure, adequate strength, low elasticity, wrinkle-resistance, intended sorption, smoothness, a flat or profiled surface, low areal weight (usually less than 30 $g/m^2$), high permeability. Another advantageous property is the electrical conductivity.

The application properties of the base material depend on the specific purpose. In the fields of cosmetics and medicine, for example, are the following additional requirements: harmlessness to human health, overall biological compatibility, subthreshold content of toxic and allergen substances including heavy metals, the product should not be irritating etc. Pharmaceutical applications require products and materials having particularly high-quality levels, mainly high homogeneity levels with maximum deviations ranging up to between 5 and 10% (which applies equally to the homogeneity of the active/curative substances which are possibly contained). Such material must be produced in validated industrial processes. According to the available information, there is no technology based on the principle of electrostatic spinning at the present time. The above listing of requirements implies that the selection of a suitable base material for a particular application will be considerably limited. At the present time, base materials made of synthetic or natural substances belonging to the following groups are mostly used: polyamide, polyester, polypropylene, polyethylene, polyurethane, polyacrylate, viscose, cellulose, cotton, etc. Planar layers made of such base materials are processed with the use of known techniques, such as weaving, knitting or spunbond/meltblown (when non-woven textiles are concerned). Such layers can also assume the form of perforated foils, paper sheets or the like.

Nevertheless, it is very difficult to comply with both the technological criteria and the application ones during production of the base materials because every application has specific requirements in terms of both the properties of the materials and the functionality of the same. Production of fibrous layers deposited onto a new substrate (either specified by the particular application or chosen by the customer) always requires lengthy processes to be used for optimizing the process parameters of the complete technological plant. The existence of the aforesaid problem results in that the manufacturers are not able to promptly respond to the requirements of their customers, that low-quality fibrous materials are often produced and that the desired extent of practical application of the novel methods for producing nanofibrous and/or microfibrous materials has not been achieved so far. The aim of the ongoing development is to provide a technology which will make it possible to produce nanofibrous or microfibrous layers at an equal speed and in the same final quality, disregarding the properties of the base material used.

The objective of the present invention is to provide a novel technical arrangement and modification of a device for performing the electrostatic spinning method. Such modification should enable thickness deviations lower than 5% to be achieved on the usable surface of a base material in a continuous production of nanofibrous and/or microfibrous layers having at least 50 cm in width, such layers being depositable on a base material that fulfils not only the technological criteria but also the essential application ones.

SUMMARY OF THE INVENTION

The drawbacks and problems of the contemporary technical solutions used for the formation of nanofibrous and/or microfibrous structured layers, which are deposited on base materials subject to a number of technological and application requirements, result in that poor-quality products are obtained (particularly with regard to the critical parameter related to the uniformity of areal distribution). Such drawbacks and problems can be limited or even eliminated by means of the technical solution according to the present invention which is based on using an electrostatic field varying in time and space (i.e., a dynamic electrostatic field) for depositing nanofibrous or microfibrous structured material with an increased thickness uniformity, such fibrous layers arranged on a base material meeting the respective application requirements.

Thus, the device for the production of nanofibrous and/or microfibrous layers having an increased thickness uniformity by spinning a liquid material (3) comprises according to the invention:

- a collecting electrode,
- a spinning nozzle for dispensing the liquid material to be spun, the spinning nozzle being provided with at least one outlet orifice, which faces the collecting electrode,
- an assembly for guiding the collecting electrode and/or for guiding a base strip along the collecting electrode or adjacent to it, such that—in the area faced by the outlet orifice of the spinning nozzle—the collecting electrode and/or the base strip move(s) in the direction MD spaced from the outlet orifice of the spinning nozzle,
- a power supply for generating a voltage within the range from 10 to 150 kV between the collecting electrode and the spinning nozzle,
- at least one body for destabilizing the locations of the points where fibres are formed on the surface of the liquid material at the outlet orifice of the spinning nozzle, and
- an assembly for repeated guiding of the body along the outlet orifice or orifices of the spinning nozzle.

According to a preferred embodiment the collecting electrode has the form of a foil having the surface resistivity ranging between 0.1 and 100,000 Ohm/square, particularly between 10 and 1,000 Ohm/square.

Preferably, the assembly for repeated guiding of the body along the outlet orifice or orifices of the spinning nozzle comprises a driving unit and an element for guiding the body along a trajectory extending in parallel to the edge of the spinning nozzle which comprises the outlet orifice or orifices, at a distance from that edge of the spinning nozzle ranging preferably between 0 and 50 mm, more preferably between 0 and 15 mm and most preferably between 0 and 5 mm.

It is also advantageous, when the assembly for guiding the collecting electrode and/or for guiding the base strip comprises a driving unit adapted for guiding the collecting electrode and/or for guiding the base strip at least in the area, which is faced by the outlet orifice or orifices of the spinning nozzle, at a speed of at least 18 m/h, preferably at least 50 m/h, particularly at least 60 m/h.

According to a particularly preferred embodiment the assembly for guiding the body in a reciprocating manner along the outlet orifice or along a plurality of the outlet orifices of the spinning nozzle comprises a pneumatic driving unit for the body and/or further comprises at least one optical sensor for scanning the position of the body in at least one range of movement thereof.

Method for the production of nanofibrous and/or microfibrous layers having an increased thickness uniformity by spinning a liquid material comprises according to the invention the following steps:

- preparing a collecting electrode and a spinning nozzle, the latter being provided with at least one outlet orifice facing the collecting electrode, and an assembly for guiding the collecting electrode and/or for guiding a base strip along the collecting electrode or adjacent to it,
- feeding the liquid material to be spun into the spinning nozzle,
- generating voltage ranging between 10 and 150 kV between the spinning nozzle and the collecting electrode to enable formation of nanofibres and/or microfibres, the collecting electrode and/or the base strip being guided in the direction MD spaced from the outlet orifice of the spinning nozzle,
- repeatedly guiding a body along the outlet orifice or orifices of the spinning nozzle and along the surface of the liquid material to cause repeated displacement of the locations of the points, where the fibres are formed on the surface of the liquid material fed into said outlet orifice or orifices.

The body is guided along the outlet orifice at least once in 10 seconds, preferably at least once in 5 seconds.

Preferably, the base strip is guided between the collecting electrode and the outlet orifice of the spinning nozzle at a speed of at least 18 m/h, preferably at least 50 m/h, particularly at least 60 m/h.

The liquid to be spun, which is fed into the spinning nozzle, is a homogeneous or heterogeneous mixture containing a spinnable polymeric substance selected from the group comprising hyaluronic acid, polyethylene oxide, polyethylene glycol, polyvinyl alcohol, polyvinyl pyrrolidone, collagen, gelatin, chitin, chitosan, heparin, inulin, fibrin, fibrinogen, pullulan, lignin, starch, agar, alginate, dextran, glycogen, beta-glucan, chondroitin sulphate, cellulose, polycaprolactone, polymers and co-polymers of lactic and glycolic acids, polyurethane, polyacrylonitrile, nylon or a combination thereof.

The collecting electrode and/or the base strip preferably forms an endless strip.

The production of nanofibrous and/or microfibrous materials using the method and device according to the present invention eliminates the qualitative drawbacks of the above mentioned technological procedures, fibrous layers and products as follows.

A polymeric solution is dosed into a needleless nozzle (or into an array of needleless nozzles), at the outlet of which the polymeric solution forms a free solution level. The aforesaid needleless nozzles form the respective spinning electrodes. Advantageously, the needleless nozzles described in the document CZ304097 can be used. A needleless nozzle of the subject type comprises at least one pair of mutually adjoining plates, at least one of those plates being provided with an array of grooves arranged on the side facing the other plate. The supply of the solution to be spun opens to the inlet end portions of the individual grooves. The outlet ends of the slots are situated at the lateral edges of the respective plates, said lateral (outlet) edges of the plates advantageously forming a groove facilitating the distribution of the solution being fed. The solution is discharged through the orifices of the nozzle onto the corresponding outlet edge where the solution freely spreads and forms individual droplets above the mouth portions of the respective orifices. The droplets can also merge, thereby forming one continuous surface extending in the lengthwise direction of the nozzle. Advantageously, the nozzle is arranged with its outlet edge directed upwards. This arrangement causes the formed fibres to be led substantially in a vertically upward direction in order to be deposited onto the base strip. Nevertheless, other arrangements of the nozzles are also conceivable, such as vertically opposite or otherwise inclined ones.

In an alternative embodiment, an aperture nozzle can be used, the solution to be spun being fed into a suitably elongated aperture. This aperture opens (has its elongated outlet orifice facing) towards the collecting electrode.

In a still another embodiment, a nozzle having the form of a tank can be used, into which the solution to be spun is fed, the orifice, i.e. the upper edge of the tank facing the collecting electrode.

In general, the level of the surface of the liquid material corresponds to that of the edge of the spinning nozzle facing (being arranged nearby) the opposite electrode (i.e. the electrode serving as the collecting electrode for the layer being deposited).

The collecting electrode and/or the base strip (if it is present) is arranged such that the spacing between the outlet openings of the nozzle and the collecting electrode and/or the base strip is preferably 8 to 30 cm, more preferably 12 to 26 cm and most preferably 14 to 20 cm.

Due to the action of the forces generated by the strong electrostatic field, an array of Taylor cones forms on the free surface of the polymeric solution being spun (or on the free surfaces of the droplets being formed on the outlet edge of the nozzle), such Taylor cones corresponding to the locations where the formation of the fibre occurs during eruption of the solution towards the opposite collecting electrode. The borders (envelope) of the space, where the corresponding ray is flying and gradually solidifying, constitute, according to a simplified approach, a cone of revolution. The base of the aforesaid imaginary cone of revolution forms a surface onto which the fibres are deposited, the thickness of the layer decreasing in the direction from the midpoint to the lateral edges. Nevertheless, the locations of the Taylor cones, where the fibres are formed on the spinning electrode, are fixed in approximately equal points. This leads to the formation of a layer exactly reflecting the locations of such fixed Taylor cones. In order to obtain a uniform distribution of the layer being formed, a continual variation of the locations of the individual Taylor cones must be ensured across the free surface of the polymeric solution along the whole needleless electrode. Such continual variation of both the locations of the points, where the fibre is being formed, causes, along with the continual change in position of the axis of the imaginary cone of revolution, a dynamic process to be initiated, said process enabling a more uniform layer of nanofibres or microfibres covering the base material to be obtained. The following two aspects have a critical importance for allowing an adequate dynamic process to be initiated:

The Taylor cones, i.e., the places where fibres are formed on the spinning electrode, are destabilized by a mechanically movable body (with a round, rectangular, square or similar cross-section) made of an electrically conductive or non-conductive material. Such body periodically passes over the free surface, on the free surface or under the free surface of the polymeric solution along the entire length of the spinning electrode in order to sequentially destabilize the positions of the individual Taylor cones.

The body passes over the surface of the spinnable solution, the maximum distance between the body and said surface being 50 mm, more preferably 20 mm and most preferably 5 mm, or under the surface of the spinnable solution, the maximum distance between the body and said surface being 5 mm in the latter case. For example, the body moving over the spinning electrode along the edge of the outlet orifice thereof can protrude into an area under the surface of the spinning solution being fed, on that surface or over that surface, the maximum distance between the body and the surface, however, being 50 mm. Advantageously, the body passes back and forth in the direction of the longitudinal axis of the outlet orifice. Nevertheless, it can also move in such a manner that it passes the outlet orifice in a single direction and returns across an area outside the outlet orifice. Moreover, more than one body can be installed, the individual bodies moving over the outlet orifice/the surface of the solution to be spun and having a certain mutual spacing. Advantageously, that part of the body, which extends into the orifice when viewed in the orthogonal projection onto the plane of level of the liquid material/onto the plane of the outlet orifice of the slot or of the tub or of the outlet channel edge, has a width in the direction perpendicular to the direction of travel of the body, said width corresponding to at least 70%, preferably more than 80% of the width of the outlet orifice.

This means that a periodical process takes places during which the respective Tylor cone ceases to exist for a short period of time following to each passage of the body and, subsequently, a new cone emerges in the same place or in another one on the surface of the polymeric solution deposited on the spinning electrode. This happens repeatedly during the individual passages of the body and throughout the deposition process. In an advantageous embodiment, the lengthwise dimension of the spinning nozzle incorporated in the device is oriented transversely to the direction of the base material being unwound; this means that the direction CD is parallel to the axis of the longer side of the spinning electrode and perpendicular to the direction MD of the base material being unwound.

The opposite electrode, which serves as a collecting electrode enabling deposition of the material being processed, is formed by a solid, smooth, planar and electrically conductive surface connected to the respective electric potential, i.e., to the opposite potential with respect to that of the spinning nozzle. In an advantageous embodiment, the aforesaid surface is formed by a base material having a reduced electrical conductivity corresponding to a range of surface resistivity values between 0.1 and 100,000 Ohm/square, more preferably between 1 and 10,000 Ohm/square and most preferably between 10 and 1,000 Ohm/square. The base material, onto which a new layer composed of nanofibres and/or microfibres will be deposited, is arranged in a close vicinity to the aforesaid conductive surface or, alternatively, adjoins the same. In an advantageous embodiment, the conductive surface moves in the same direction and at the same speed as the base material does, the unwinding velocity being higher than 30 cm/min (18 m/h), preferably higher than 100 cm/min (60 m/h).

The collecting electrode is composed of an electrically conductive material (such as an electrically conductive surface layer, an electrically conductive foil, or the like) or of a material having reduced electrical conductivity. The base material is attached to the surface of the material constituting the collecting electrode or arranged in a close vicinity thereto, preferably both the materials being unwound at a necessary speed. This is effectuated either a) simultaneously, from one roll to the other one by means of unwinding and winding rollers, i.e. using the so-called "roll-to-roll" technique, or b) simultaneously, by means of a mechanism for driving a so-called endless strip in rotation, or c) by means of the combination of both the aforesaid mechanisms, wherein the base material is unwound from one roll and wound to the other one and the conductive material assuming the form of an endless strip is driven in rotation, both the materials moving at the same speed.

According to an advantageous embodiment, an electrically conductive electrode or an electrode having reduced electrical conductivity is constituted by a foil having a smooth, non-absorbent surface, an electrically conductivity value corresponding to the range of surface resistivity values between 1 and 10,000 Ohm/square, and high chemical resistance. Without presenting any theoretical proof, it was experimentally ascertained that the properties of smooth surfaces with reduced electrical conductivity values enable a more uniform coverage of such surfaces with nanofibres or microfibres which are deposited after having been prepared using the electrostatic spinning method.

Advantageously, the liquid material to be spun is a spinnable homogeneous or heterogeneous mixture containing a spinnable polymer or a combination of such polymers and, optionally, one or more additives incorporated directly into the fibrous layers being formed, a solvent system and other substances promoting the spinning process. Spinnable polymeric substances include, for example, hyaluronic acid, polyethylene oxide, polyethylene glycol, polyvinyl alcohol, polyvinyl pyrrolidone, collagen, gelatin, chitin, chitosan, heparin, inulin, fibrin, fibrinogen, pullulan, lignin, starch, agar, alginate, dextran, glycogen, beta-glucan, chondroitin sulphate, cellulose, polycaprolactone, polymers and co-polymers of lactic and glycolic acids, polyurethane, polyacrylonitrile, nylon and other synthetic or natural polymers.

The processed liquid material can contain the aforesaid polymers either individually or in a combination of two or more polymers.

The polymers may assume their natural form or any suitable derivative form.

Furthermore, the liquid polymeric material to be spun can contain water-miscible solvents and, optionally, other substances (non-solvents) for the polymers used and promoting the spinning process (such as surfactants, additives for increasing the electrical conductivity or the like). The liquid material can further contain admixtures belonging to the group of active substances, such as antiallergics, antibiotics, antimycotics, antineoplastics, antiphlogistics, antivirotics, antiglaucomatics, antiseptics or diagnostic substances.

By means of the above mentioned processes, the thickness uniformity of deposited nanofibrous or microfibrous layers can be improved. This applies to the entire surface area of a layer deposited on a base material. Furthermore, the above described layers can be laid on the other with the aim to obtain a high value of areal weight, which is not achievable through the electrostatic spinning process itself, or carried over onto another base material. Such additional base material does not necessarily need to meet the essential criteria of technological suitability for the electrostatic spinning production process. Instead, the latter material can be suitable in view of the final application of the fibrous layer produced or of a product comprising such layer. The entire production process, which is based on the electrostatic spinning method implemented in the above described way, is much more versatile, more reliable in terms of obtaining a desired product, and more flexible. Consequently, high-quality products based on nanofibrous and/or microfibrous layers made of various material can be obtained.

BRIEF DESCRIPTION OF THE DRAWINGS

The invention is further described with reference to the exemplary embodiments and to the accompanying drawings, where FIG. 1A to 1D schematically show the exemplary arrangements described in the present document and the results obtained by means of such arrangements, including graphs.

EXEMPLARY EMBODIMENTS OF THE INVENTION

Figure 1A:
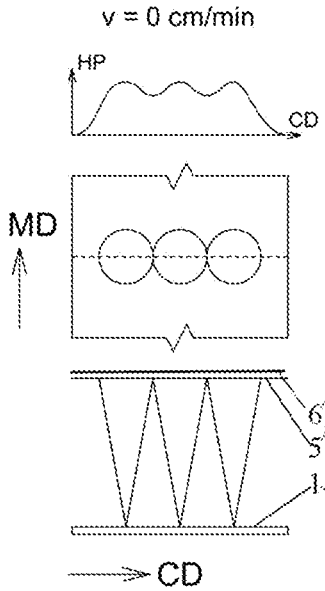
Figure 1B:
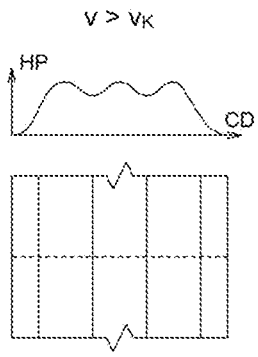
Figure 1C:
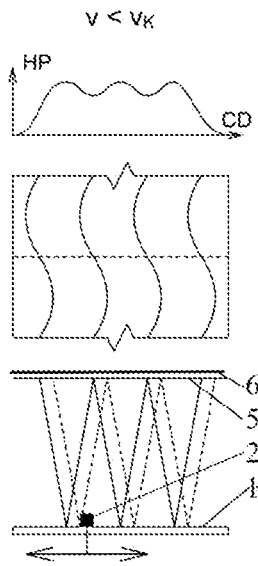
Figure 1D:
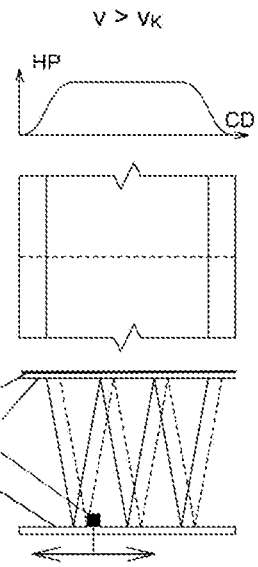

FIG. 1A illustrates a spinning process wherein the material coming out of the nozzle 1 is deposited on a stationary base strip 5, FIG. 1B illustrates a spinning process wherein the material coming out of the nozzle 1 is deposited on the base strip 5 being unwound at a speed, which is higher than critical speed $v_k$, thus over critical speed (which substantially corresponds to the Example 2), FIG. 1C illustrates a spinning process wherein the material coming out of the nozzle 1 is deposited on the base strip 5 being unwound at a speed, which is lower than critical speed, thus an under-critical speed, and wherein the deposition is influenced by the integrated body 2 (which substantially corresponds to the Example 3), and FIG. 1D illustrates a spinning process wherein the material coming out of the nozzle 1 is deposited on the base strip 5 being rapidly unwound at an overcritical speed and wherein the deposition is also influenced by the integrated body 2 (which substantially corresponds to the Example 4). The top row of each of FIGS. 1A to 1D includes graphs of the obtained weight profiles along the lateral direction CD, the middle row indicates possible shapes of the patterns formed on the surface of the base material and the bottom row shows the individual arrangements, each being composed of a nozzle 1, a base strip 5 and a collecting electrode 6 as seen in the direction MD. The imaginary cones, which are also indicated in the bottom row, delimit the areas within which a flying fibre 4 is expected to pass through.

Figure 2A:
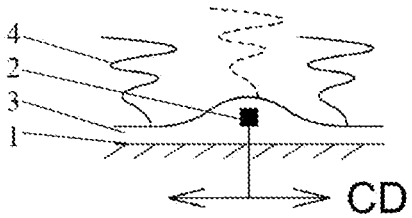
FIG. 2A schematically shows the principle of destabilizing the locations of the points, where fibres are formed, by moving a body immediately under the surface of the solution to be spun.
Figure 2B:
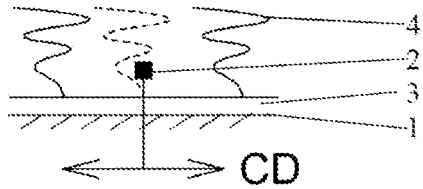
FIG. 2B shows a similar scheme where the body is moved immediately over the surface of the solution to be spun.
Figure 2C:
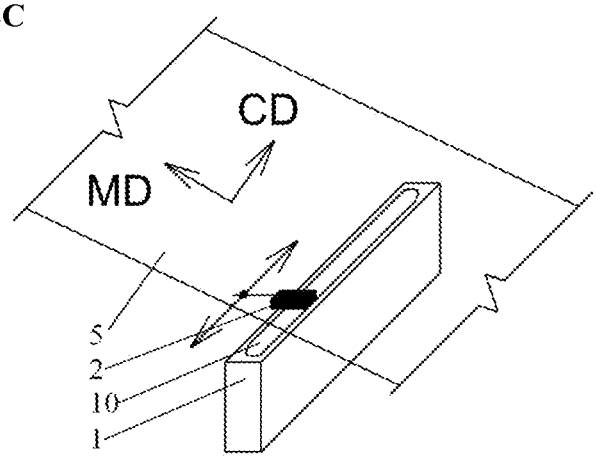
FIG. 2C schematically shows an aperture-type spinning nozzle along with a movable body.

FIG. 2C schematically shows the aperture-type spinning nozzle 1 that forms the spinning electrode and has its outlet orifice 10 facing the base strip 5 for depositing the fibres 4 formed during the process. The longitudinal axis of the outlet orifice 10 extends substantially in parallel to the direction CD, which is perpendicular to the direction MD, the latter direction corresponding to that of the movement of the base strip 5 in the place which is faced by the outlet orifice 10. In the vicinity of the edge of the outlet orifice 10, a body 2 is arranged, said body being capable to carry out a reciprocating motion in the lengthwise direction of the respective outlet orifice 10. In the present exemplary embodiment, a motion from one end of the outlet orifice to the other one and vice versa is concerned, the constant distance between the body and the respective edge of the outlet orifice 10 being, for example, 5 mm.

When the device is in operation, the liquid material 3 to be spun is forcibly fed into the aperture in order to cause the level of the surface of liquid material 3 to be spun to approximately correspond to the level of the edge of the outlet orifice 10 or to lie immediately above or below that edge. Thereby, the body 2 moves immediately above the surface of the liquid. The fibres 4 being formed are being thus disrupted in the close vicinity to the surface, i.e., in the close vicinity to the points where the fibres are being formed during the eruption of the spun liquid material 3 towards the opposite collecting electrode 6. This situation corresponds to that shown in FIG. 2B, while FIG. 2A illustrates a situation where the moving body 2 is partly submerged under the surface of the liquid material and where the motion of the body also interferes with the locations of the points where Taylor cones are formed or, as the case may be, causes the latter cones to be displaced.

Figure 3:
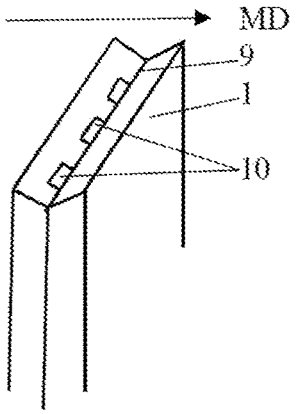
FIG. 3 shows a spinning nozzle comprising an array of outlet orifices in a schematical view.

The above described aperture-type spinning nozzle 1 can be advantageously replaced with a spinning nozzle 1 provided with an array of outlet orifices 10 arranged across the outlet face of the spinning nozzle 1, the latter face forming a groove 9 for collecting the possibly spilled liquid material 3 during spinning, as schematically shown in FIG. 3. The size of the outlet orifices 10 of such spinning nozzle can be, for example, 2×1 mm, the number of the orifices depending on the length of the spinning nozzle 1 or on that of the groove 9.

Figure 4:
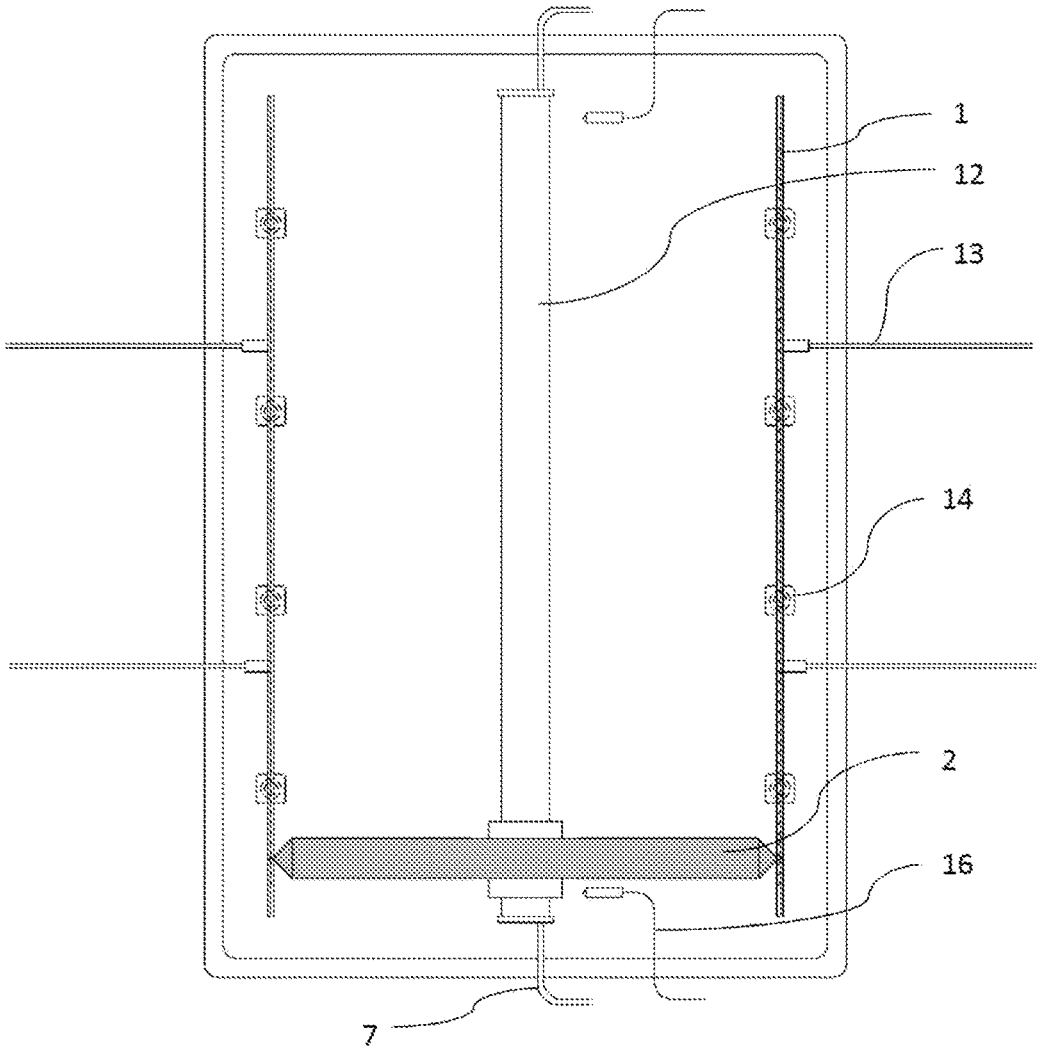
FIG. 4 shows an exemplary embodiment of the device according to the invention in a schematical view, the viewing direction being from the collecting electrode.

The movable body 2 can be guided, for example, by means of pneumatically driven mechanisms provided with non-electrical end-position control sensors (such as pneumatic sensors, optical sensors, or the like). An apt exemplary embodiment is shown in FIG. 4, where a pair of mutually parallel spinning nozzles 1 is recognizable, said nozzles being electrically interconnected with a high-voltage or very-high-voltage supply by means of an intermediate coupling line 14. Simultaneously, the spinning nozzles 1 are fluidly connected to the supply 13 of the liquid material 3 to be spun. Furthermore, the embodiment shown comprises an elongated body 2 for destabilizing the locations of the points where fibres 4 are formed on the surface of the liquid material 3 in the vicinity of the outlet orifice 10 of the spinning nozzle 1. One of the ends of the movable body 2 extends over the line of arrangement of the outlet orifices 10 of the first spinning nozzle 1 (or, as the case may be, adjoins said line), while the other end of said movable body extends over the line of arrangement of the outlet orifices 10 of the other spinning nozzle 1.

Inside the intermediate space between the spinning nozzles 1, a pneumatic driving unit 12 is arranged, said pneumatic driving unit 12 being connected with the movable body 2 and adapted for guiding the movable body 2 in a direction that is parallel to the longitudinal axes of the spinning nozzles 1 (i.e., that extends along the array of the spinning orifices 10), said direction advantageously corresponding to the direction CD. The pneumatic drive 12 is connected to the compressed air supply 7.

The illustrated device further comprises a pair of optical sensors 16, which are interconnected with a control unit (not shown) assigned to the pneumatic driving unit 12 and adapted for transmitting a signal containing information on the proximity of the movable body 2 to the respective end position or on reaching the end position of the movable body 2 for the purpose of changing the direction of the reciprocating movement thereof.

Advantageously, the spinning nozzle 1 or the pair of spinning nozzles 1 is arranged in a manner causing the orthogonal projection of the longitudinal axis of the outlet orifice 10 or of the edge, which incorporates the outlet orifices 10, into the plane of the collecting electrode 6 and/or into that of the base strip 5 to extend perpendicularly to the direction MD, thus corresponding to the direction CD; nevertheless, it is also possible to arrange the spinning nozzle in a manner causing the angle formed between said projection and the direction MD to be acute rather than perpendicular.

Preferably, the device comprises two or more spinning nozzles 1 arranged with a mutual spacing in the direction MD.

Example 1

Figure 5:
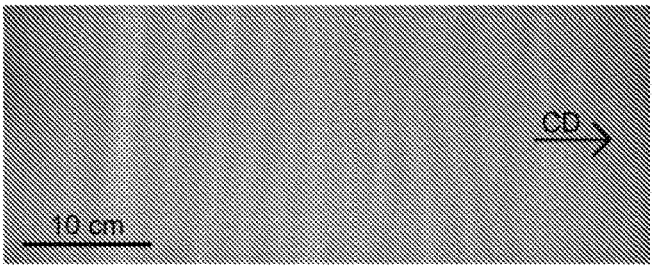
FIG. 5 shows a backlight photograph of a layer that has been obtained in a process described with reference to the Example 1.

According to this exemplary embodiment, a 12% polyvinyl alcohol (PVA) solution was processed by spinning. The solution was fed at a speed of 2.4 ml/min in total into a pair of needleless spinning nozzles 1 constituting spinning electrodes, the longer sides of the latter extending in the direction CD (i.e., the lengthwise direction of the outlet orifice/outlet edge was parallel to the direction CD). The length of the outlet orifice 10 of each spinning nozzle 1 was 600 mm, the mutual spacing of the spinning nozzles being 400 mm (as measured in the direction MD). An electric potential of +45 kV was applied to the spinning nozzles 1. The spinning process took place in an air-conditioned spinning chamber, the relative humidity and the temperature inside the latter being (20±5) % RH and (23±2) ° C., respectively. The fibres 4 were deposited onto the surface of the base strip 5 consisting of a knitted 100% polyester fabric, the distance between the strip and the spinning nozzles 1 being 18 cm. The above base strip 5 was attached to a foil having reduced electrical conductivity and forming a collecting electrode 6. An electric potential of −30 kV was applied to the above foil. Then, both the above materials were unwound at a speed of (25±5) cm/min in the direction MD, thereby forming a so-called endless strip having a total length of 120 cm. The deposition was taking place during a period of time totalling 20 minutes. The image of the final layer obtained by means of the backlight photography technique is shown in FIG. 5.

Example 2

Figure 6:
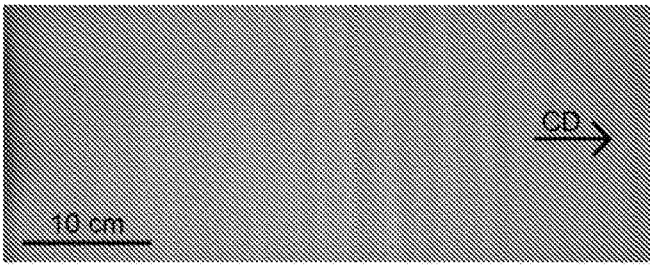
FIG. 6 shows a backlight photograph of a layer that has been obtained in a process described with reference to the Example 2.

According to an exemplary embodiment, a 12% polyvinyl alcohol (PVA) solution was processed by spinning. The solution was fed at a speed of 2.4 ml/min in total into a pair of needleless spinning nozzles 1 constituting spinning electrodes, the longer sides of the latter extending in the direction CD. The length of the outlet orifice 10 of each spinning nozzle 1 was 600 mm, the mutual spacing of the spinning nozzles being 400 mm (as measured in the direction MD). An electric potential of +45 kV was applied to the spinning nozzles 1. The spinning process took place in an air-conditioned spinning chamber, the relative humidity and the temperature inside the latter being (20±5) % RH and (23±2) ° C., respectively. The fibres 4 were deposited onto the surface of the base strip 5 consisting of a knitted 100% polyester fabric, the distance between the strip and the spinning nozzles 1 being 18 cm. The above base strip 5 was attached to a foil having a reduced electrical conductivity and forming a collecting electrode 6. An electric potential of −30 kV was applied to the above foil. Both the above materials were reeled at a speed of (100±5) cm/min in the direction MD forming a so-called endless strip having a total length of 120 cm. The deposition was taking place for 20 minutes. The image of the final layer obtained by means of the backlight photography technique is shown in FIG. 6.

Example 3

Figure 7:
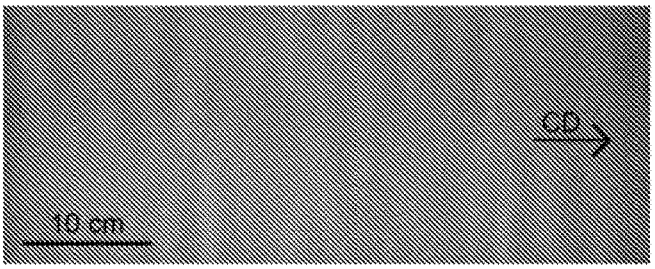
FIG. 7 shows a backlight photograph of a layer that has been obtained in a process described with reference to the Example 3.

According to an exemplary embodiment, a 12% polyvinyl alcohol (PVA) solution was processed by spinning. The solution was fed at a speed of 2.4 ml/min in total into a pair of needleless spinning nozzles 1 constituting spinning electrodes, the longer sides of the latter extending in the direction CD. The length of the outlet orifice 10 of each spinning nozzle 1 was 600 mm, the mutual spacing of the spinning nozzles being 400 mm (as measured in the direction MD). At a distance of (10±5) mm from the upper edge of each spinning nozzle 1, a body 2 made of an electrically non-conductive material was moved above the upper edge along the whole length of the outlet orifice 10 of the spinning nozzle 1 continuously and during the whole process, the speed of the latter being (15±5) cm/s. An electric potential of +45 kV was applied to the spinning nozzles 1. The spinning process took place in an air-conditioned spinning chamber, the relative humidity and the temperature inside the latter being (20±5) % RH and (23±2) ° C., respectively. The fibres 4 were deposited onto the surface of the base strip consisting of a knitted 100% fabric, the distance between the strip and the spinning nozzles 1 being 18 cm. The above base strip 5 was attached to a foil having a reduced electrical conductivity and forming a collecting electrode 6. An electric potential of −30 kV was applied to the above foil. Both the above materials were reeled at a speed of (25±5) cm/min in the direction MD forming a so-called endless strip having a total length of 120 cm. The deposition was taking place for 20 minutes. The image of the final layer obtained by means of the backlight photography technique is shown in FIG. 7.

Example 4

Figure 8:
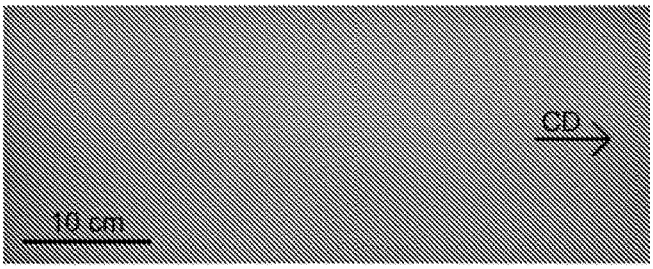
FIG. 8 shows a backlight photograph of a layer that has been obtained in a process described with reference to the Example 4.

According to an exemplary embodiment, a 12% polyvinyl alcohol (PVA) solution was processed by spinning. The solution was fed at a speed of 2.4 ml/min in total into a pair of needleless spinning nozzles 1 constituting spinning electrodes, the longer sides of the latter extending in the direction CD. The length of the outlet orifice 10 of each spinning nozzle 1 was 600 mm, the mutual spacing of the spinning nozzles being 400 mm (as measured in the direction MD). At a distance of (10±5) mm from the upper edge of each spinning nozzle 1, a body 2 made of an electrically non-conductive material was moved above the upper edge along the whole length of the outlet orifice 10 of the spinning nozzle 1 continuously and during the whole process, the speed of the latter being (15±5) cm/s. An electric potential of +45 kV was applied to the spinning nozzles 1. The spinning process took place in an air-conditioned spinning chamber, the relative humidity and the temperature inside the latter being (20±5) % RH and (23±2) ° C., respectively. The fibres 4 were deposited onto the surface of the base strip 5 consisting of a knitted 100% polyester fabric, the distance between the strip and the spinning nozzles 1 being 18 cm. The above base strip 5 was attached to a foil having a reduced electrical conductivity and forming a collecting electrode 6. An electric potential of −30 kV was applied to the above foil. Both the above materials were reeled at a speed of (100±5) cm/min in the direction MD, thereby forming a so-called endless strip having a total length of 120 cm. The deposition was taking place during a period of time totalling 20 minutes. The image of the final layer obtained by means of the backlight photography technique is shown in FIG. 8.

Example 5

Figure 9:
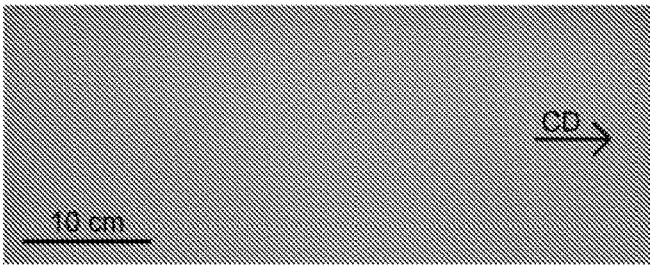
FIG. 9 shows a backlight photograph of a layer that has been obtained in a process described with reference to the Example 5.

According to an exemplary embodiment, an aqueous 8% polyethylene oxide (PEO) solution was processed by spinning. The solution was proportioned at a speed of 3.0 ml/min into a pair of needleless spinning nozzles 1 constituting spinning electrodes, the longer sides of the latter extending in the direction CD. The length of the outlet orifice 10 of each spinning nozzle 1 was 600 mm, the mutual spacing of the spinning nozzles being 400 mm (as measured in the direction MD). At a distance of (10±5) mm from the upper edge of each spinning nozzle 1, a body 2 made of an electrically non-conductive material was moved above the upper edge along the whole length of the outlet orifice 10 of the spinning nozzle 1 continuously and during the whole process, the speed of the latter being (15±5) cm/s. An electric potential of +45 kV was applied to the spinning nozzles 1. The spinning process took place in an air-conditioned spinning chamber, the relative humidity and the temperature inside the latter being (20±5) % RH and (23±2) ° C., respectively. The fibres 4 were deposited onto the surface of the base strip 5 consisting of a 100% knitted fabric, the distance between the strip and the spinning nozzles 1 being 18 cm. The above base strip 5 was attached to a foil having a reduced electrical conductivity and forming a collecting electrode 6. An electric potential of −30 kV was applied to the above foil. Both the above materials were reeled at a speed of (200±5) cm/min in the direction MD forming a so-called endless strip having a total length of 120 cm. The deposition was taking place for 20 minutes. The image of the final layer obtained by means of the backlight photography technique is shown in FIG. 9.

Example 6

Figure 10:
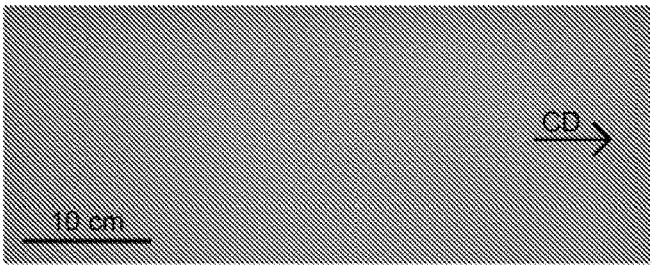
FIG. 10 shows a backlight photograph of a layer that has been obtained in a process described with reference to the Example 6.

According to an exemplary embodiment, an aqueous 6% solution based on the mixture of hyaluronic acid and polyethylene oxide (PEO) was processed by spinning, the mixing ratio of the underlying mixture being 4:1. The solution was fed at a speed of 2.5 ml/min into a pair of needleless spinning nozzles 1 constituting spinning electrodes, the longer sides of the latter extending in the direction CD. The length of the outlet orifice 10 of each spinning nozzle 1 was 600 mm, the mutual spacing of the spinning nozzles being 400 mm (as measured in the direction MD). At a distance of (10±5) mm from the upper edge of each spinning nozzle 1, a body 2 made of an electrically non-conductive material was moved above the upper edge along the whole length of the outlet orifice 10 of the spinning nozzle 1 continuously and during the whole process, the speed of the body being (15±5) cm/s. An electric potential of +45 kV was applied to the spinning nozzles 1. The spinning process took place in an air-conditioned spinning chamber, the relative humidity and the temperature inside the latter being (20±5) % RH and (23±2) ° C., respectively. The fibres 4 were deposited onto the surface of the base strip 5 consisting of a knitted 100% polyester fabric, the distance between the strip and the spinning nozzles 1 being 18 cm. Subsequently, the above base strip 5 was attached to a foil having a reduced electrical conductivity and forming a collecting electrode 6. An electric potential of −30 kV was applied to the above foil. Then, both the above materials were unwound at a speed of (200±5) cm/min in the direction MD, thereby forming a so-called endless strip having a total length of 120 cm. The deposition was taking place for 20 minutes. The image of the final layer obtained by means of the backlight photography technique is shown in FIG. 10.

The results of the analyses of the layers prepared according to the exemplary embodiments 1 to 6 are summarized in the Table 1.

TABLE 1

| Exemplary embodiment | Use of the body 2 | Speed of the base strip 5 (cm/min) | Standard deviation of the pixel intensity |
|---|---|---|---|
| 1 | No | 25 | 12.5 |
| 2 | No | 100 | 10.0 |
| 3 | Yes | 25 | 11.8 |
| 4 | Yes | 100 | 6.6 |
| 5 | Yes | 200 | 2.6 |
| 6 | Yes | 200 | 3.2 |

INDUSTRIAL APPLICABILITY

The invention is particularly useful in the fields of the production of nanostructured and/or microstructured layers or, as the case may be, nanofibrous and/or microfibrous layers obtained by means of the electrostatic spinning method, such layers being produced in the form of self-supporting layers or in the form of layers deposited on a base material.

The invention claimed is:

1. A device for the production of nanofibrous and/or microfibrous layers having an increased thickness uniformity by spinning a liquid material, said device comprising:

a collecting electrode, a spinning nozzle for dispensing the liquid material to be spun, the spinning nozzle being provided with at least one outlet orifice, which faces the collecting electrode, an assembly for guiding the collecting electrode and/or for guiding a base strip along the collecting electrode or adjacent to it, such that—in an area faced by the outlet orifice of the spinning nozzle—the collecting electrode and/or the base strip move(s) in the direction (MD) spaced from the outlet orifice of the spinning nozzle, a power supply for generating a voltage of 10 to 150 kV between the collecting electrode and the spinning nozzle, at least one body for destabilizing locations of points where fibres are formed on the surface of the liquid material at the outlet orifice of the spinning nozzle, and an assembly for repeated guiding of the body along the outlet orifice or orifices of the spinning nozzle.

2. The device according to claim 1, wherein the collecting electrode has a form of a foil having a surface resistivity ranging between 0.1 and 100,000 Ohm/square.

3. The device according to claim 1, wherein the assembly for repeated guiding of the body along the outlet orifice or orifices of the spinning nozzle comprises a driving unit and an element for guiding the body along a trajectory extending in parallel to that edge of the spinning nozzle which comprises the outlet orifice or orifices, at a distance from that edge of the spinning nozzle ranging between 0 and 50 mm.

4. The device according to claim 1, wherein the assembly for guiding the collecting electrode and/or for guiding the base strip comprises a driving unit adapted for guiding the collecting electrode and/or for guiding the base strip at least in the area, which is faced by the outlet orifice or orifices of the spinning nozzle, at a speed of at least 18 m/h.

5. The device according to claim 1, wherein the assembly for repeated guiding of the body in along the outlet orifice or along a plurality of the outlet orifices of the spinning nozzle comprises a pneumatic driving unit for the body and/or further comprises at least one sensor for scanning the position of the body in at least one range of movement thereof.

6. A method for producing nanofibrous and/or microfibrous layers having an increased thickness uniformity by spinning a liquid material, said method comprising the following steps:

preparing a collecting electrode and a spinning nozzle, the latter being provided with at least one outlet orifice facing the collecting electrode, and an assembly for guiding the collecting electrode and/or for guiding a base strip along the collecting electrode or adjacent to the collecting electrode, feeding the liquid material to be spun into the spinning nozzle, generating voltage ranging between 10 and 150 kV between the spinning nozzle and the collecting electrode to enable formation of nanofibres and/or microfibres, the collecting electrode and/or the base strip being guided in the direction (MD) and spaced from the outlet orifice of the spinning nozzle, and repeatedly guiding a body along the outlet orifice or orifices of the spinning nozzle and along the surface of the liquid material to cause repeated displacement of the locations of the points, where the fibres are formed on the surface of the liquid material being fed into said outlet orifice or orifices.

7. The method according to claim 6, wherein the body is guided along the outlet orifice at least once in 10 seconds.

8. The method according to claim 6, wherein the base strip is guided between the collecting electrode and the outlet orifice of the spinning nozzle at a speed of at least 18 m/h.

9. The method according to claim 6, wherein the liquid to be spun, which is fed into the spinning nozzle, is a homogeneous or heterogeneous mixture containing a spinnable polymeric substance selected from the group comprising hyaluronic acid, polyethylene oxide, polyethylene glycol, polyvinyl alcohol, polyvinyl pyrrolidone, collagen, gelatin, chitin, chitosan, heparin, inulin, fibrin, fibrinogen, pullulan, lignin, starch, agar, alginate, dextran, glycogen, beta-glucan, chondroitin sulphate, cellulose, polycaprolactone, polymers and co-polymers of lactic and glycolic acids, polyurethane, polyacrylonitrile, nylon or a combination thereof.

10. The method according to claim 6, wherein the collecting electrode and/or the base strip is guided in the machine direction (MD) in the form of an endless belt.

11. The device according to claim 4, wherein the speed is at least 50 m/h.

12. The device according to claim 4, wherein the speed is at least 60 m/h.

13. The method according to claim 8, wherein the speed is at least 50 m/h.

14. The method according to claim 8, wherein the speed is at least 60 m/h.

* * * * *